US005763822A

United States Patent [19]

Kubota et al.

[11] Patent Number: 5,763,822

[45] Date of Patent: Jun. 9, 1998

[54] COAXIAL CABLE

[75] Inventors: Hiroshi Kubota; Toshio Takahashi, both of Nisshin, Japan

[73] Assignee: Advanced Mobile Telecommunication Technology Inc., Nisshin, Japan

[21] Appl. No.: 600,362

[22] Filed: Feb. 13, 1996

[30] Foreign Application Priority Data

Aug. 30, 1995 [JP] Japan ..... 7-221765

[51] Int. Cl.[6] ..... H01B 7/20; H01P 3/06

[52] U.S. Cl. ..... 174/36; 174/103; 174/106 R

[58] Field of Search ..... 174/126.1, 106 R, 174/126.2, 103, 36; 333/243, 241, 12

[56] References Cited

U.S. PATENT DOCUMENTS 3,553,344 1/1971 Capehart ..... 174/36
4,376,920 3/1983 Smith ..... 333/12 X
4,383,225 5/1983 Mayer ..... 333/12 X
4,871,883 10/1989 Guiol ..... 174/36

*Primary Examiner*—Hyung S. Sough
*Assistant Examiner*—Chau N. Nguyen
*Attorney, Agent, or Firm*—Lane, Aitken & McCann

[57] ABSTRACT

In a coaxial cable comprising a cylindrical conductor tube structure, a cylindrical core conductor arranged within the conductor tube structure, and a dielectric member provide between the conductor tube structure and the core conductor, the conductor tube structure is constituted by a cylindrical outer conductor and a cylindrical inner conductor provided within the outer conductor in coaxial and radially spaced relationship with the outer conductor to be capacitively coupled with the outer conductor. The inner conductor has a first axial end portion protruded axially outwardly from one end of the outer conductor and a second axial end portion received in the outer conductor retracted axially inwardly from the other end of the outer conductor. The outer and inner conductors of the conductor tube structure are thermally insulated from each other thereby reducing heat transmission between the outer and inner conductors without lessening conductivity for high frequency signals.

3 Claims, 3 Drawing Sheets

COAXIAL CABLE

BACKGROUND OF THE INVENTION

The present invention relates to a coaxial cable, and in particular to a coaxial cable suitable for transmitting high frequency signals therethrough to a device maintained at a constant temperature.

The coaxial cable of this type comprises a cylindrical conductor tube structure and a solid cylindrical core conductor arranged in coaxial relationship with the conductor tube structure. In general, such the coaxial cable is balanced in impedance and has transmission properties superior to those of various known balanced type cables because of the fact that the coaxial cable has a shielded structure and is less in transmission losses and crosstalk noises than the conventional cables.

Conventionally, there have been provided a wide variety of coaxial cables the typical type of which is shown in FIG. 3 as comprising a cylindrical conductor tube structure 1 having a center axis, a solid cylindrical core conductor 2 arranged within the conductor tube structure 1 in coaxial relationship with the conductor tube structure 1, and a hollow cylindrical dielectric member 3 provided between the conductor tube structure 1 and the core conductor 2 to encircle and support the center conductor 2. The coaxial cable herein disclosed is designated by the reference numeral 4 in FIG. 3 and has one end portion received in a thermostatic bath 5. The thermostatic bath 5 is designed to house a device operative to receive or output high frequency signals but not shown in the drawings. The above coaxial cable 4 forms two transmission lines for transmitting high frequency signals between the device in the thermostatic bath 5 and signal generating means not shown in the drawings.

When the high frequency signals are produced by the signal generating means and inputted to the conductor tube structure 1, the signals are transmitted to the device housed in the thermostatic bath 5 through the conductor tube structure 1 at a high electric conductivity. When the conductor tube structure 1 made of a material such as for example a metal having a high heat conductivity is heated or cooled by the atmosphere around the thermostatic bath 5, the device housed in the thermostatic bath 5 is susceptible to a thermal effect through the coaxial cable 4 since the conductor tube structure 1 has a large heat conductivity in addition to its high electric conductivity in spite of the fact that the thermostatic bath 5 has heat insulator barriers sufficient to maintain its inner temperature.

The prior art coaxial cable is therefore required to lessen the heat conductivity of the conductor tube structure without reducing the electric conductivity for high frequency signals.

SUMMARY OF THE INVENTION

It is therefore an object of the present invention to provide a coaxial cable capable of reducing heat transmission through its conductor tube structure with a high conductivity for high frequency broadband signals.

It is another object of the present invention to produce a coaxial cable of low heat conductivity at a low cost.

According to one aspect of the present invention there is provided a coaxial cable comprising a cylindrical conductor tube structure having a center axis, a cylindrical core conductor arranged within the conductor tube structure to extend along the center axis of the conductor tube structure, and a dielectric member provided between the conductor tube structure and the core conductor to encircle and support the core conductor in coaxial relationship with the conductor tube structure. The conductor tube structure is constituted by a cylindrical outer conductor and a cylindrical inner conductor provided within the outer conductor in coaxial and radially spaced relationship with the outer conductor to be capacitively coupled with the outer conductor. The inner conductor has a first axial end portion protruded axially outwardly from the outer conductor and a second axial end portion received in the outer conductor.

The dielectric member may have a cylindrical outer portion arranged between the outer and inner conductors of the conductor tube structure, and a cylindrical inner portion arranged between the inner conductor of the conductor tube structure and the core conductor. The cylindrical outer portion of the dielectric member may be larger in heat conductivity than the cylindrical inner portion of the dielectric member.

The outer conductor of the conductor tube structure preferably has a thickness smaller than that of the inner conductor of the conductor tube structure.

BRIEF DESCRIPTION OF THE DRAWINGS

The features and advantages of a coaxial cable according to the present invention will be more clearly understood from the following description taken in conjunction with the accompanying drawings in which.

DESCRIPTION OF THE PREFERRED EMBODIMENTS

Figure 1:
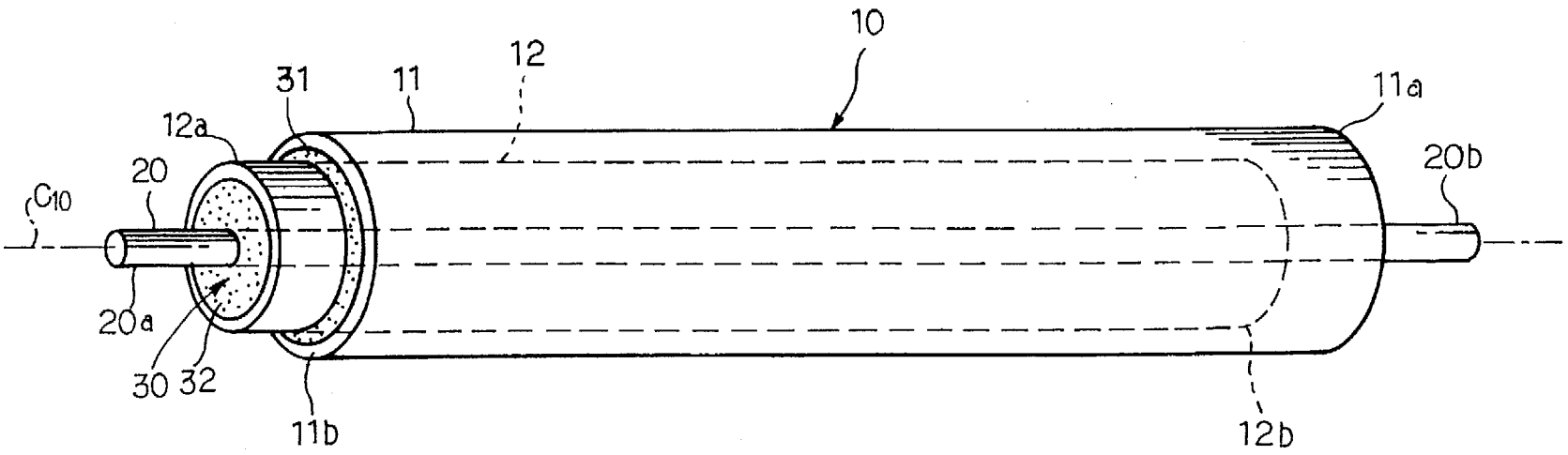
FIG. 1 is a perspective schematic view of a preferable embodiment of the coaxial cable according to the present invention.
Figure 2:
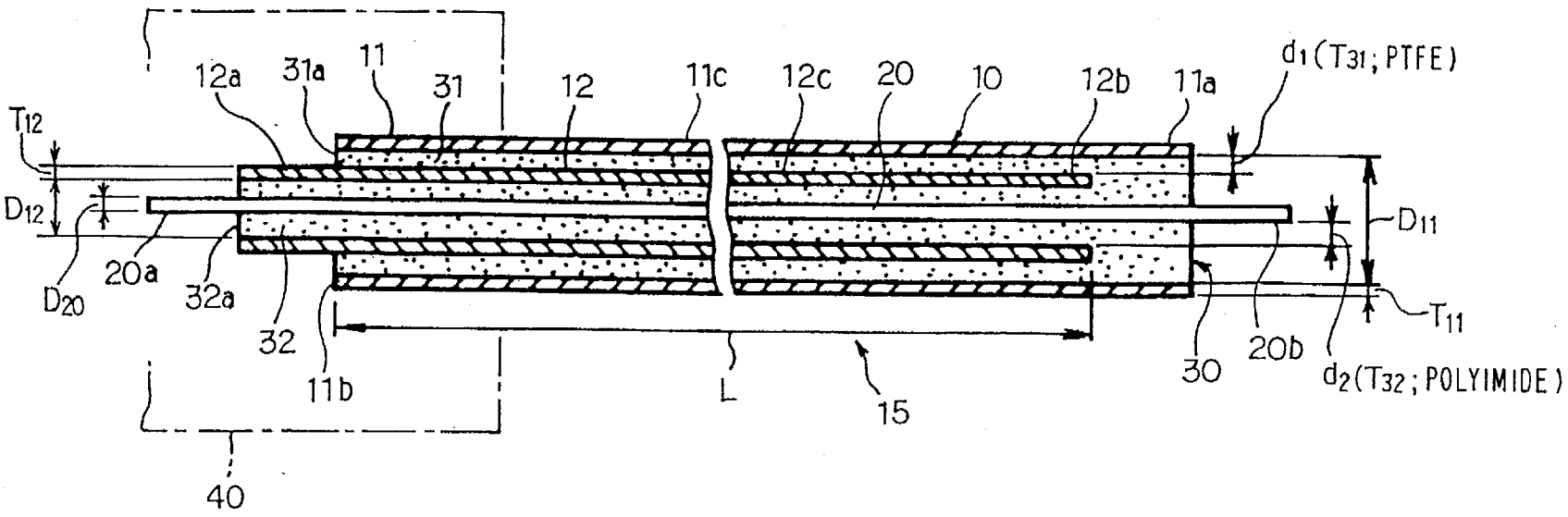
FIG. 2 is a longitudinal sectional view of the coaxial cable showing a conductor tube structure having cylindrical outer and inner conductors and forming part of the coaxial cable.
Figure 3:
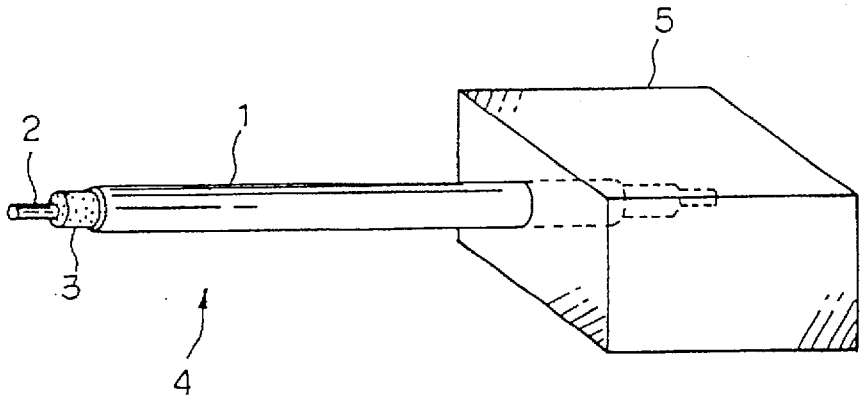
FIG. 3 (PRIOR ART)
FIG. 3 is a perspective view of a prior art coaxial cable having one end portion received in a thermostatic bath.

Referring to FIGS. 1 and 2 of the drawings, a preferable embodiment of a coaxial cable embodying the present invention is shown as comprising a cylindrical conductor tube structure 10 having a center axis C10, a cylindrical core conductor 20 arranged within the conductor tube structure 10 to extend along the center axis C10 of the conductor tube structure 10, and a dielectric member 30 provided between the conductor tube structure 10 and the core conductor 20 to encircle and support the core conductor 20 in coaxial relationship with the conductor tube structure 10.

The conductor tube structure 10 is constituted by a hollow cylindrical outer conductor 11 and a hollow cylindrical inner conductor 12 smaller in diameter than the outer conductor 11 and thus provided within the outer conductor 11 in coaxial and radially spaced relationship with the outer conductor 11. The outer conductor 11 has a first axial end portions 11*a*, a second axial end portion 11*b* and an intermediate portion 11*c*. The first axial end portion 11*a* of the outer conductor 11 is electrically connected to an electric device which is adapted to output or receive high frequency signals, while the second axial end portion 11*b* and the intermediate portion 11*c* of the outer conductor 11 are designed to jointly encircle the inner conductor 12. The inner conductor 12 has a first axial end portion 12*a*, a second axial end portion 12*b* and an intermediate portion 12*c*. The first axial end portion 12*a* of the inner conductor 12 is protruded axially outwardly from the second end portion 11*b* of the outer conductor 11 and exposed in the air to be electrically connected to an electric device which is adapted to receive or output the high frequency signals but not shown in the drawings. The second axial end portion 12*b* and the intermediate portion 12*c* of the inner conductor 12 are received in the outer conductor 11, and the second axial end portion 12*b* of the inner conductor 12 is retracted from the first end portion 11*a* of the outer conductor 11 and thus unexposed in the air. The second axial end portion 12*b* of the inner conductor 12 is preferably covered by the dielectric member 30 as shown in FIG. 2.

The outer conductor 11 of the conductor tube structure 10 may have a thickness smaller than that of the inner conductor 12 of the conductor tube structure 10. The outer conductor 11 and the inner conductor 12 may be constituted by different conductive materials, and the outer conductor 11 preferably consists of thin-film tube.

The intermediate portions 11*c* and 12*c* of the outer and inner conductors 11 and 12 are radially superimposed on and spaced form each other to respectively act as capacitor plates and as a whole constituting a coupling capacitor 15 having the outer and inner conductors 11 and 12 capacitively coupled with each other. The coupling capacitor 15 has a large electrostatic capacity sufficient to transmit high frequency broadband signals.

The core conductor 20 is constituted by a solid cylindrical conductive member such as for example a silver coated copper wire, and has a first axial end portion 20*a* to be electrically connected to the above electric device operative to receive or output high frequency signals and a second axial end portion 20*b* to be electrically connected to the electric device operative to output or receive the high frequency signals. The radially spacing distance "d1" between outer conductor 11 and the inner conductor 12 of the conductor tube structure 10 is smaller than the radially spacing distance "d2" between the inner conductor 12 of the conductor tube structure 10 and the core conductor 20 as shown in FIG. 2.

The dielectric member 30 includes a cylindrical outer portion 31 arranged between the outer conductor 11 and the inner conductor 12, and a cylindrical inner portion 32 arranged between the inner conductor 12 and the core conductor 20. The outer portion 31 of the dielectric member 30 is made of polyimide, whilst the inner portion 32 of the dielectric member 30 is made of PTFE (polytetrafluoroethylene). The inner portion 32 of the dielectric member 30 has an axial end portion 32*a* axially outwardly protruded from the axial end 31*a* of the outer portion 31 of the dielectric member 30 in such a manner that the first axial end portion 20*a* of the core conductor 20 is supported by the first axial end portion 12*a* of the inner conductor 12 through the axial end portion 32*a* of the inner portion 32. Although the outer and inner portions 31 and 32 of the dielectric member 30 are particularly shown in FIG. 2 as being partly connected with each other, "the outer and inner portions 31 and 32 may be separated from each other if desired". The outer portion 31 of the dielectric member 30 may have a heat conductivity larger than that of the inner portion 32 of the dielectric member 30. This means that the outer portion 31 of the dielectric member 30 may be replaced by a heat insulator made of a material different from the dielectric material of the inner portion 32 of the dielectric member 30.

The reference numeral 40 designates a thermostatic bath having one end portion of the coaxial cable received therein. The first axial end portions 12*a* and 20*a* of the inner and core conductors 12 and 20 are jointly connected to the above electric device housed in the thermostatic bath, while the second axial end portion 11*b* of the outer conductor 11 is spaced apart from and thus thermally separated from the electric device housed in the thermostatic bath. The thermostatic bath 40 is designed to maintain the electric device at a predetermined constant temperature.

In the coaxial cable constructed as aforementioned, the electrostatic capacity of the coupling capacitor 15 is set at for example 164 pF(picofarad) in the case that the coaxial cable comprises a conductor tube structure 10 including an outer conductor 11 made of copper and having a thickness T11 of 18 μm and an inner diameter D11 of 3.93 mm, an inner conductor 12 made of copper and having a thickness T12 set at 0.3 mm and an inner diameter D12 of 2.98 mm, and a coupling capacitor 15 having an axial length "L" set at 8 cm. The coaxial cable further comprises a dielectric member 30 including an outer portion 31 having a thickness T31 set at 175 μm and an inner portion 32 having a thickness T32 set at 1.034 mm, and a core conductor 20 having a diameter D20 of 0.912 mm.

The operation of the coaxial cable will be described hereinlater.

The coaxial cable is firstly arranged to have one end portion received in the thermostatic bath 40. The first axial end portion 12*a* of the inner conductor 12 and the first axial end portion 20*a* of the core conductor 20 are then connected to the electric device operative to input or output high frequency broadband signals in the thermostatic bath 40, while the first axial end portion 11*a* of the outer conductor 11 and the second axial end portion 20*b* of the core conductor 20 are respectively connected to the electric device operative to output or input high frequency broadband signals. Under these conditions, the coaxial cable forms two conductor transmission lines between the above electric devices with the second axial end portion 11*b* of the outer conductor 11 thermally separated from the electric device in the thermostatic bath.

One of the electric devices is then operated to output high frequency broadband signals and the other of the electric devices is operated to input the high frequency broadband signals from the above one of the electric devices to transmit the high frequency signals through the conductor tube structure 10 and the core conductor 20 of the coaxial cable. At this time, the high frequency signals are maintained at a suitable signal level even under the state that the high frequency signals are relatively low in frequency since the coupling capacitor 15 has a large electrostatic capacity depending upon the sizes of the intermediate portions 11*c* and 12*c* of the outer and inner conductors 11 and 12 of the conductor tube structure 10. At the same time, the coaxial cable can be sufficiently selfshielded by the reason that the high frequency signal are transmitted by the inner surface portion of the outer conductor 11 and the outer surface portion of the core conductor 20.

If, on the other hand, the outer conductor 1 is heated or cooled by the atmosphere around the thermostatic bath 40, the temperature of the outer conductor 11 is varied in response to the temperature of the atmosphere to have a temperature level different from that of the inner conductor 12. The inner conductor 12 is however thermally insulated from the outer conductor 11 by their radially spacing distance "d1" and the outer portion 31 of the dielectric member 30 with the second axial end portion 11*b* of the outer conductor 11 held thermally separated from the electric device in the thermostatic bath 40. This leads to the fact that the above electric device housed in the thermostatic bath 40 can be maintained at a constant temperature without being thermally affected through the outer conductor 11 of the conductor tube structure 10.

It will therefore be understood that the coaxial cable according to the present invention is capable of reducing heat transmission through its conductor tube structure without lessening its conductivity for high frequency broadband signals. In addition, it is unnecessary for the outer conductor of the conductor tube structure to be constituted by a thick conductive metal tube having high rigidity and a large cross sectional area, thereby making it possible to provide a coaxial cable at a low cost. Furthermore, the electrostatic capacity of the coupling capacitor is large sufficient to transmit high frequency signals relatively low in frequency between the outer and inner conductors of the conductor tube structure through the coupling capacitor, thereby enabling to lessen the transmission loss of the high frequency broadband signals.

The present invention has thus been shown and described with reference to specific embodiments, however, it should be noted that the present invention is not limited to the details of the illustrated structures but changes and modifications may be made without departing from the scope of the appended claims.

What is claimed is:

1. A coaxial cable comprising:

a cylindrical conductor tube structure having a center axis;

a cylindrical core conductor arranged within said conductor tube structure to extend along said center axis of said conductor tube structure; and a dielectric member provided between said conductor tube structure and said core conductor to encircle and support said core conductor in coaxial relationship with said conductor tube structure; in which said conductor tube structure is constituted by a cylindrical outer conductor and a cylindrical inner conductor provided within said outer conductor in coaxial and radially spaced relationship with said outer conductor to be capacitively coupled with said outer conductor, said inner conductor having a first axial end portion protruded axially outwardly from one end of said outer conductor and a second axial end portion received in said outer conductor retracted axially inwardly from the other end of said outer conductor, said dielectric member having a cylindrical outer portion arranged between said outer and inner conductors of said conductor tube structure, a cylindrical inner portion arranged between said inner conductor of said conductor tube structure and said core conductor, and a portion covering said second axial end portion of said inner conductor.

2. A coaxial cable as set forth in claim 1, in which said outer conductor of said conductor tube structure has a thickness smaller than that of said inner conductor of said conductor tube structure.

3. A coaxial cable as set forth in claim 1, in which said cylindrical outer portion of said dielectric member is larger in heat conductivity than said cylindrical inner portion of said dielectric member.

* * * * *